US008807461B2

(12) United States Patent
Blattner et al.

(10) Patent No.: US 8,807,461 B2
(45) Date of Patent: Aug. 19, 2014

(54) SHOWER HEAD

(75) Inventors: Joachim Blattner, Haslach (DE); Ulrich Kinle, Schenkenzell (DE)

(73) Assignee: Hansgrohe SE, Schiltach (DE)

( * ) Notice: Subject to any disclaimer, the term of this patent is extended or adjusted under 35 U.S.C. 154(b) by 448 days.

(21) Appl. No.: 12/477,441

(22) Filed: Jun. 3, 2009

(65) Prior Publication Data

US 2009/0307836 A1 Dec. 17, 2009

(30) Foreign Application Priority Data

Jun. 6, 2008 (DE) ..... 10 2008 028 215

(51) Int. Cl.
*B05B 1/18* (2006.01)
*B05B 15/06* (2006.01)

(52) U.S. Cl.
CPC ..... *B05B 1/185* (2013.01); *B05B 15/066* (2013.01)
USPC ..... 239/557; 239/548; 239/556; 239/587.1; 239/518

(58) Field of Classification Search
USPC ..... 239/455, 460, 548, 552, 556, 557, 239/587.4, 587.5, 505, 518, 519, 587.1, 567
See application file for complete search history.

(56) References Cited

U.S. PATENT DOCUMENTS

| | | | | |
|---|---|---|---|---|
| 6,250,572 | B1 * | 6/2001 | Chen | 239/602 |
| 6,463,658 | B1 * | 10/2002 | Larsson | 29/890.142 |
| 6,739,527 | B1 * | 5/2004 | Chung | 239/558 |
| 7,246,760 | B2 * | 7/2007 | Marty et al. | 239/587.4 |
| 7,278,591 | B2 * | 10/2007 | Clearman et al. | 239/380 |
| 2002/0158154 | A1 * | 10/2002 | Lee | 239/548 |
| 2008/0087747 | A1 | 4/2008 | Kajuch | |
| 2008/0210777 | A1 | 9/2008 | Lacher et al. | |
| 2008/0223957 | A1 | 9/2008 | Schorn | |

FOREIGN PATENT DOCUMENTS

| | | | |
|---|---|---|---|
| AT | 405795 | B | 11/1999 |
| DE | 3044310 | A1 | 6/1982 |
| DE | 3044310 | C2 | 6/1982 |
| DE | 19802917 | A1 | 5/1999 |
| DE | 102004059329 | A1 | 6/2006 |
| DE | 102005010550 | A1 | 10/2006 |
| EP | 1700636 | A2 | 9/2006 |
| GB | 1160996 | | 8/1969 |
| WO | 2006093954 | A1 | 9/2006 |

OTHER PUBLICATIONS

German Patent & Trademark Office, Search Report in corresponding German Appln. No. 10 2008 028 215.4, Apr. 7, 2009.
EP Search Report dated Sep. 9, 2009 in parallel application 09006929.5. See p. 2 for table applying cited references.

* cited by examiner

*Primary Examiner* — Jason Boeckmann
(74) *Attorney, Agent, or Firm* — Duane Morris LLP

(57) ABSTRACT

A showerhead contains a chamber in connection with a connecting nozzle, said chamber from which the water is discharged from plurality of nipples formed on a membrane formed out of elastomeric material. The nipples feature a duct for the shower water. The nipples penetrate through openings of a perforated disc through the openings slightly larger than the outside diameter of the nipple. By shifting the perforated disc in a plane parallel to the membrane featuring the nipples, the direction of the nipple and thus the direction of the water jets discharged from the nipples will be changed. This adjustment can occur in two directions that are perpendicular to one another. The membrane is preferably approximately plane in shape, so that a front surface of the showerhead is likewise plane in shape.

9 Claims, 2 Drawing Sheets

SHOWER HEAD

The invention relates to a showerhead for a sanitary fitting with several jet outlet elements that discharge the shower water as outlet jet in a defined direction.

A side shower is already known, in which perforations in a row are disposed on the front side of a pipe, through which the hose pieces project. On the external side of the pipe, a sleeve is attached, which features corresponding openings. By shifting this sleeve, the direction of the hose pieces can be changed together. Through the hose pieces water comes out through a direction determined by the arrangement of the hose pieces (DE 3044310).

The invention is based on the task of providing a showerhead that allows a variety of applications and easy handling.

To solve this task the invention proposes a showerhead for a sanitary fitting with the features cited in claim 1. Further developments of the invention are object of dependent claims.

Although in the state of the art the side shower only has one row of jet outlet elements, the showerhead according to the invention features jet outlet elements that are disposed in a surface. These jet outlet elements are adjustable in at least two directions at an angle to one another, for example an angle of 90°.

In a further development of the invention, it can be provided that the adjustment can be performed by the user holding the housing of the showerhead itself, so that an additional lever or actuation element that could disturb the appearance of the showerhead housing is dispensed with.

The direction, in which the jet outlet elements with their outlet jets can be adjusted, can be provided by a forced guiding mechanism in a further development according to the invention.

The surface, in which the jet outlet elements are arranged, can feature an arbitrary form. It is particularly advantageous, however, if this surface is a level surface.

To achieve that the jet outlet elements discharge the outlet jets in a defined direction, which is particularly important in an arrangement of the jet outlet elements in a surface, it can be provided in a further development of the invention that the jet outlet elements are formed as nipples that feature an outlet channel, which leads to a jet outlet opening. Careful alignment of the direction of the outlet jets takes place through the channel.

In a further development of the invention, it can be provided that the jet outlet elements, in particular the nipples, are mounted in a swiveling manner in the showerhead. By swiveling the jet outlet elements together, the direction of water jets can be changed together.

In particular, it can be provided that the jet outlet elements are made of or formed on a membrane of elastomeric material. This membrane can additionally take on sealing functions.

If the jet outlet elements involve nipples, it can be provided according to the invention that these penetrate through the openings of a disc disposed in the showerhead, which is guided in a displaceable manner relative to the rest part of the showerhead and the displacement of which determines or changes the direction of the outlet jets.

The openings in the disc must hence be slightly larger than the outer diameter of the nipple so that, change of the direction of the nipple takes place through the displacement.

In order not to let the details of the type of the change of direction be too obvious, the showerhead housing can additionally be covered by an external cover, which is designed according to aesthetic or artistic points of view.

In particular, the showerhead housing according to the invention can be designed as a flat level shower, for example with a square face surface.

The invention proposes that the adjustment of the direction be designed in a defined manner, so that a set direction can be retained.

According to the invention, a neutral or zero position can also be provided, which can be fixable by the user by a click-stop device or similar.

Further features, details and preferences of the invention result from the claims and the abstract, wherein both wordings refer to the content of the description, of the following description of preferred embodiments of the invention and of the drawing. The figures are as follows:

Figure 1:
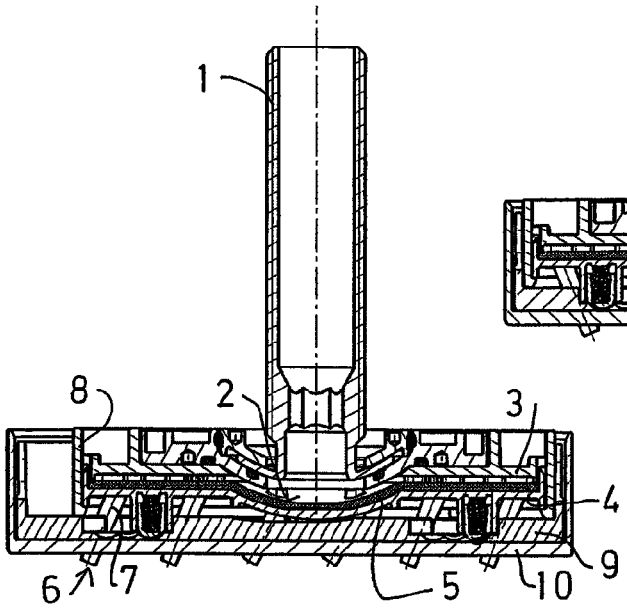
FIG. 1 shows a section through a showerhead according to the invention

A connection nozzle 1 that serves for the connection with a water hose leads from the rear side in the showerhead housing shown in FIG. 1. The showerhead housing contains a chamber 2 that is demarcated by a rear wall 3 and a front wall 4 running approximately parallel to former.

A membrane 5 lies on the inner side of the front wall 4. On the membrane 5, jet outlet elements 6 are formed in form of elongated nipples 7. The nipples project forward through the front wall 4.

A frame 8 is formed around the chamber 2 formed between der rear wall 3 and the front wall 4.

Figure 2:
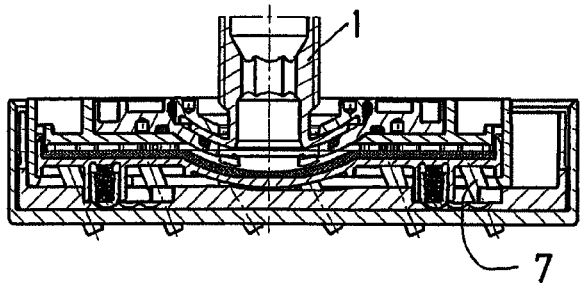
FIG. 2 shows the same section of the jet outlet elements in a second position

Opposite the connection nozzle 1, in front of the front wall 4, a perforated disc 9 is disposed in a displaceable manner in the direction of its own plane in FIG. 1 towards the right and left as well as upwards and downwards. The perforated disc 9 contains an opening for each jet outlet element that is slightly larger than the outer diameter of the respective nipples 7. In the position that the perforated disc 9 takes in FIG. 1 all the nipples 7 are shifted such that its front end that forms the jet outlet opening is further left than its connection with the membrane 5. If one now shifts the perforated disc 9 from the position of FIG. 1 towards the right, then the nipple 7 reaches the position depicted in FIG. 2.

A cover 10 covering the perforated disc 9 frontally and peripherally is disposed in front of the perforated disc 9.

Figure 3:
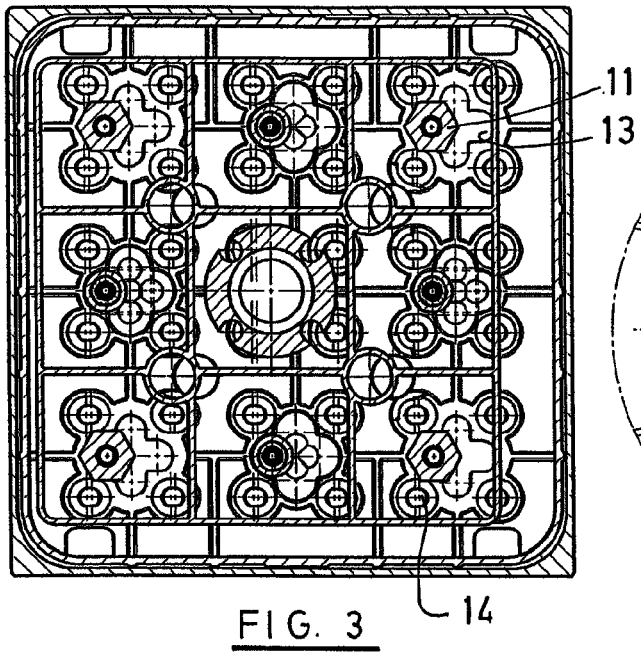
FIG. 3 shows a section through the showerhead housing in a transverse plane relative to the direction of FIG. 1
Figure 4:
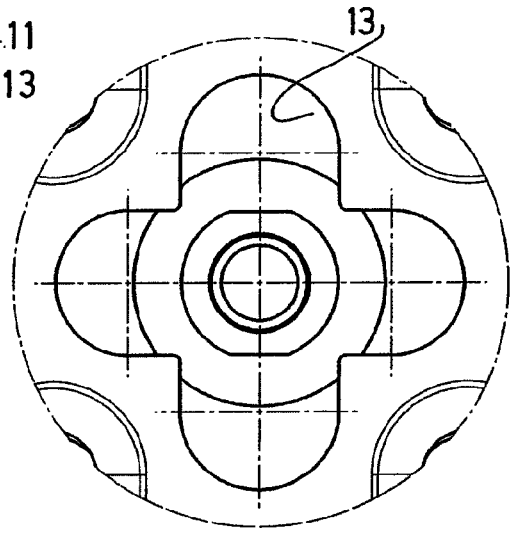
FIG. 4 shows the type of forced guiding mechanism for displacement, in a magnified scale

As can be seen in the section of FIG. 3, for the connection of the perforated disc 9 with the other showerhead housing, a row of fixing elements 11 is provided, which feature a nut-type head 12. These elements 11 penetrate from the unit formed by the rear wall 3, front wall 4 and frame 8 through the openings 13 to the front into the perforated disc 9. These openings 13 of the perforated disc 9 are depicted in FIG. 4 in a magnified scale. Each opening 13 features the form of two overlapping ovals, wherein the ovals are equipped with parallel sides. Through this, it is possible to limit the direction of the displacement of the perforated disc 9 to two directions perpendicular to one another, and hence also the extent of the displacement.

The perforated disc 9 also features openings 14 for the nipples 7 of the jet outlet elements 6 to break through, besides the openings 13 for the fixing elements 11.

Figure 5:
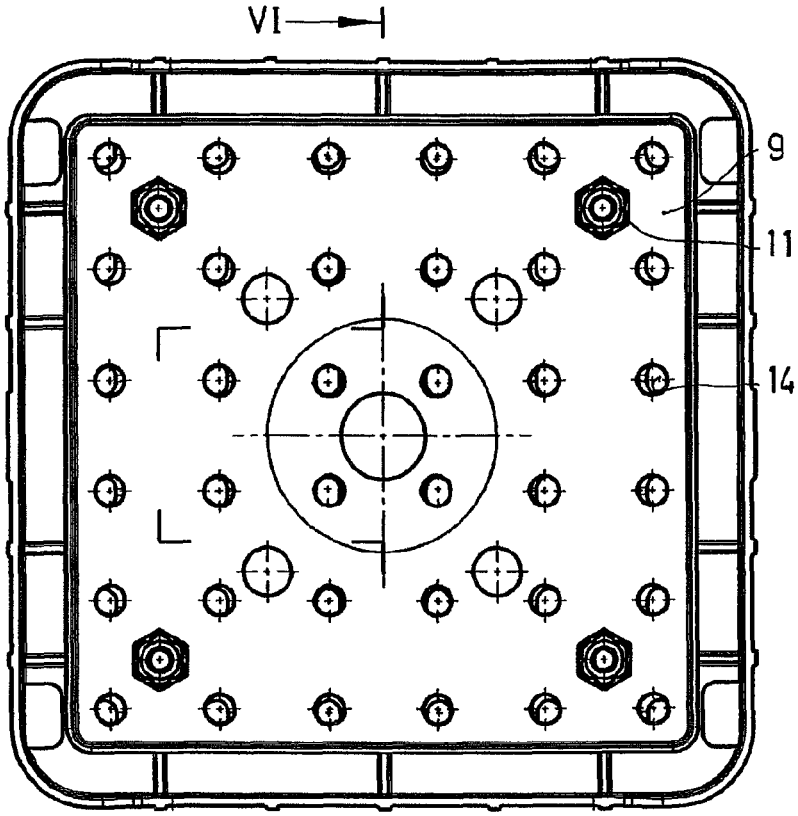
FIG. 5 shows a front view of the housing with a removed cover

FIG. 5 shows a front view of the showerhead housing with a removed cover 10. In the front view, it is visible that the perforated disc 9 is in a middle position in the position depicted here. As already mentioned, four fixing means 11 seen as hexagon heads in FIG. 5 serve for fixing purposes.

Moreover, passage openings 14 for the nipples 7 disposed in six rows are apparent. There are 36 openings for the corresponding 36 nipples 7.

Figure 6:
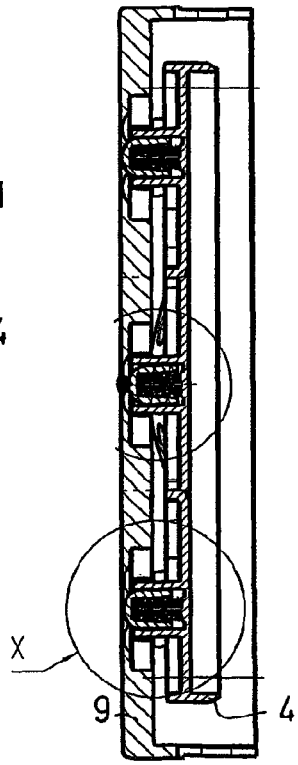
FIG. 6 shows a section along the longitudinal line VI-VI in FIG. 5
Figure 7:
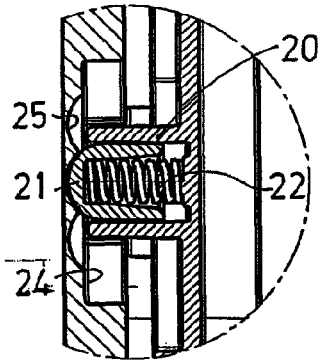
FIG. 7 shows a magnified detail view

FIG. 6 shows a cross-section along line VI-VI in FIG. 5. On the front side of the front wall 4, hollow nozzles 20 are formed, see also FIG. 7. In the hollow nozzles 20 pressure pieces 21 are accommodated, which are pressurized by a pressure spring 22 from the hollow nozzle 20. The pressure pieces 21 feature a rounded front side, which they are pressurized against the rear side of the perforated plate 9. In the rear side of the perforated disc 9, the recesses 23, in which the hollow nozzles 20 interlock, are formed. Centrally on the base 24 of each recess 23, there are partially spherical depressions 25, which interact with the rounded front side of the pressure pieces 21. FIG. 7 shows the interlocking of the pressure piece 21 in a middle depression 25 according to a middle or zero position of the perforated disc 9 and thus of a zero position of the direction of the water jets discharging from the nipples 7. By looking carefully, one can detect the depressions 25, which are depicted in a larger scale in FIG. 7 and also in FIGS. 1 and 2.

For the displacement of the perforated disc 9 and hence for concurrent adjustment of the direction of the water jets discharging from the jet outlet elements, a user can intervene on the external side of the cover disc 10 and displace it, wherein the direction and the extent of the displacement is determined through the form of the openings 13.

We claim:

1. A showerhead for a sanitary fitting, comprising:

a frame defining a rear wall and a front wall;

a front cover disc in front of the frame, wherein the front cover is displaceable two-dimensionally in its own plane relative to the frame, wherein the front cover disc provides an outer housing front part of the showerhead;

a plurality of jet outlet elements, the respective jet outlet elements being disposed at respective locations over two dimensions on a surface adjacent to the front wall, and the jet outlet elements each extend forward through openings of the displaceable front cover disc, corresponding to the respective locations of the jet outlet elements on the surface, each of said jet outlet elements discharging shower water as an outlet jet in a direction from a respective location of the jet outlet element on the surface to a respective one of the openings in the front cover disc, wherein all the jet outlet elements discharge shower water in a same direction, which direction is changeable to a set direction and remains at the set direction for all the jet outlet elements together, by displacement of the front disc two-dimensionally in its own plane relative to the frame, thereby determining a discharge direction of the showerhead;

wherein a user can change the set direction of all the outlet jets together, and thereby change the discharge direction of the showerhead, by displacing the front cover disc two-dimensionally in its own plane relative to the frame.

2. The showerhead according to claim 1, wherein the surface on which the locations of the jet outlet elements are disposed is a plane surface.

3. The showerhead according to claim 1, wherein the surface on which the locations of the jet outlet elements are disposed is a dome-shaped surface.

4. The showerhead according to claim 1, wherein jet outlet openings of the jet outlet elements are disposed along a plane surface.

5. The showerhead according to claim 1, wherein jet outlet openings of the jet outlet elements are disposed along a dome-shaped surface.

6. The showerhead according to claim 1, wherein the jet outlet elements comprise nipples, each defining an outlet duct that is angularly movable relative to one of the locations on the surface adjacent to the front wall and leads to a jet outlet opening.

7. The showerhead according to claim 1, wherein the jet outlet elements are mounted in the showerhead in a manner allowing swiveling of the jet outlet elements.

8. The showerhead according to claim 1, wherein the jet outlet elements are formed of a membrane comprising an elastomeric material.

9. The showerhead according to claim 8, wherein the membrane comprises said surface on which the jet outlet elements are disposed at the respective locations, said membrane being on an inner side of the front wall.

* * * * *